US011629907B2

(12) United States Patent
Lee et al.

(10) Patent No.: US 11,629,907 B2
(45) Date of Patent: Apr. 18, 2023

(54) REFRIGERATOR

(71) Applicant: SAMSUNG ELECTRONICS CO., LTD., Suwon-si (KR)

(72) Inventors: Yeongjun Lee, Suwon-si (KR); Kyoungsun Park, Suwon-si (KR); Hyunnam Park, Suwon-si (KR); Hosang Park, Suwon-si (KR); Jinhong Yu, Suwon-si (KR); Jisick Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/168,570

(22) Filed: Feb. 5, 2021

(65) Prior Publication Data

US 2021/0239390 A1 Aug. 5, 2021

(30) Foreign Application Priority Data

Feb. 5, 2020 (KR) ..... 10-2020-0013831

(51) Int. Cl.
*F25D 25/02* (2006.01)
*F25D 23/06* (2006.01)
(Continued)

(52) U.S. Cl.
CPC ..... *F25D 25/025* (2013.01); *A47B 88/40* (2017.01); *F25D 23/067* (2013.01);
(Continued)

(58) Field of Classification Search
CPC ..... F25D 25/025; F25D 23/067; F25D 25/02; F25D 25/024; A47B 88/40; A47B 88/417; A47B 2210/0059; A47B 2210/175
See application file for complete search history.

(56) References Cited

U.S. PATENT DOCUMENTS

2016/0178274 A1 6/2016 Shin
2017/0191742 A1 7/2017 Lim et al.

FOREIGN PATENT DOCUMENTS

CN 102374747 10/2014
CN 205174989 U * 4/2016
(Continued)

OTHER PUBLICATIONS

PCT International Search Report for International Application No. PCT/KR2021/001511 dated Jun. 1, 2021.
(Continued)

*Primary Examiner* — Kimberley S Wright
(74) *Attorney, Agent, or Firm* — Staas & Halsey LLP

(57) ABSTRACT

Provided is a refrigerator having a supporting frame whose installation structure is enhanced. The refrigerator includes an inner case defining a storeroom and having a projection formed to protrude to the inside of the storeroom, a drawer arranged to be inserted or pulled out from the storeroom, and a supporting frame arranged in the storeroom to guide movements of the drawer, and installed at the projection, wherein the supporting frame includes a fixer arranged on a side of the supporting frame to prevent the supporting frame from deviating from the projection, the fixer being deformed when pressurized by the projection and restored to an original state when the pressure from the projection is released.

19 Claims, 18 Drawing Sheets

(51) Int. Cl.
*A47B 88/40* (2017.01)
*A47B 88/417* (2017.01)

(52) U.S. Cl.
CPC ..... *A47B 88/417* (2017.01); *A47B 2210/0059* (2013.01); *A47B 2210/175* (2013.01)

(56) References Cited

FOREIGN PATENT DOCUMENTS

| | | | | | |
|---|---|---|---|---|---|
| CN | 107024057 | A | | 8/2017 | |
| CN | 107144083 | A | * | 9/2017 | ..... F25D 25/025 |
| CN | 105466138 | | | 1/2019 | |
| EP | 2098810 | A2 | * | 9/2009 | ..... F25D 25/025 |
| JP | 11-132649 | | | 5/1999 | |
| JP | 3294964 | | | 4/2002 | |
| JP | 2005-156133 | | | 6/2005 | |
| KR | 20-1988-0006689 | | | 5/1988 | |
| KR | 10-0389639 | | | 6/2003 | |
| KR | 10-2009-0133009 | | | 12/2009 | |
| KR | 10-1313552 | | | 10/2013 | |
| KR | 10-1427277 | | | 8/2014 | |
| KR | 10-2019-0088310 | | | 7/2019 | |
| KR | 10-2019-0088317 | | | 7/2019 | |
| KR | 10-2028022 | | | 10/2019 | |
| KR | 10-2034293 | | | 11/2019 | |

OTHER PUBLICATIONS

Extended European Search Report dated Sep. 29, 2022 for European Application No. 21751147.6.

* cited by examiner

REFRIGERATOR

CROSS-REFERENCE TO RELATED APPLICATION

This application is based on and claims priority under 35 U. S. C. § 119 to Korean Patent Application No. 10-2020-0013831 filed on Feb. 5, 2020, the disclosure of which is incorporated herein by reference in its entirety.

BACKGROUND

1. Field

The disclosure relates to a refrigerator, and more particularly, to a refrigerator having a supporting frame whose installation structure is enhanced.

2. Discussion of Related Art

Refrigerators are devices having a storeroom and a cold air supply for supplying cold air into the storeroom to keep groceries fresh.

Temperatures in the storeroom remain within a certain range required to keep the groceries fresh.

The storeroom has an open front, which is closed by a door at ordinary times to maintain the temperature of the storeroom.

The storeroom is partitioned by a wall into a freezer chamber and a fridge chamber, the freezer and fridge chambers being opened or closed by the respective doors.

There are drawers detachably arranged in the fridge and freezer chambers to make accommodating rooms to keep groceries, and the drawers may be inserted to or pulled out from the fridge and freezer chambers.

The drawer is formed as a separate part from an inner case that defines the storeroom, so the drawer may be trembled from side to side, making noise while inserted to or pulled out from the storeroom.

SUMMARY

According to an aspect of the disclosure, a refrigerator includes an inner case defining a storeroom and having a projection formed to protrude to the inside of the storeroom, a drawer arranged to be inserted or pulled out from the storeroom, and a supporting frame arranged in the storeroom to guide movements of the drawer, and installed at the projection, wherein the supporting frame includes a fixer arranged on a side of the supporting frame to prevent the supporting frame from deviating from the projection, the fixer being deformed when pressurized by the projection and restored to an original state when the pressure from the projection is released.

The supporting frame may include a guide rib formed to guide movements of the drawer, and the fixer may include an insertion projection arranged to be separated from the guide rib by a cut, and an elastic connector connecting the guide rib to the insertion projection.

The elastic connector may be elastically deformed as the insertion projection is pushed upwards by pressure from the projection, and restored to an original state when the pressure from the projection is released.

The projection may include a fixing groove formed to correspond to the fixer, and the insertion projection may be inserted to the fixing groove.

The insertion projection may be pushed upwards by pressure from the projection, and when the insertion projection is located above the fixing groove, the pressure from the projection may be released and the insertion projection may be returned to the original state and inserted to the fixing groove.

The insertion projection may have a slope arranged to come into contact with the projection, and the projection may push up the insertion projection while sliding on the slope.

The elastic connector may be formed behind the insertion projection.

The elastic connector may be formed in front of the insertion projection.

The supporting frame may be inserted to and installed in an installation groove formed by the projection.

The supporting frame may include an elastic supporter formed on a side of the supporting frame to prevent the supporting frame from moving from side to side.

The fixer may be formed on a bottom surface of the guide rib.

An upper portion of the drawer may be slidably inserted to a guide groove formed by the guide rib.

The drawer is a first drawer and the guide rib is a first guide rib, and the refrigerator may further include a second drawer arranged above the first drawer, and a second guide rib formed on the supporting frame to guide movements of the second drawer.

The supporting frame may include a main body arranged between the first drawer and the second drawer, and the first guide rib may be formed to protrude downwards from the main body, and the second guide rib may be formed to protrude upwards from the main body.

The second guide rib may support a lower portion of a side of the second drawer to prevent the second drawer from moving from side to side.

According to another aspect of the disclosure, a refrigerator includes an inner case defining a storeroom and having a projection formed to protrude to the inside of the storeroom, a plurality of drawers arranged in the storeroom to be movable, and a supporting frame arranged between the plurality of drawers to support the plurality of drawers and fixed at the projection, wherein the supporting frame includes a main body, a first guide rib protruding downwards from the main body to support one of the drawers, a fixer arranged on the first guide rib to be elastically deformable in a vertical direction to fix the supporting frame at the projection, and an elastic supporter arranged on a side of the main body to be elastically deformable in a left and right direction to support the supporting frame.

The supporting frame may further include a second guide rib protruding upwards from the main body to support the other one of the drawers.

The projection may include a fixing groove formed to correspond to the fixer, and the fixer is inserted to the fixing groove.

The main body may include a stopper formed to protrude upwards from the main body to restrict movement radius of the drawer supported by the second guide rib.

The drawer supported by the second guide rib may include a stopping projection matching the stopper, the stopping projection may move along with the drawer supported by the second guide rib, and the stopper may restrict movement radius of the stopping projection.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which:

FIG. 17 is a perspective view of a supporting frame of a refrigerator, according to another embodiment of the disclosure; and.

DETAILED DESCRIPTION

Figure 1:
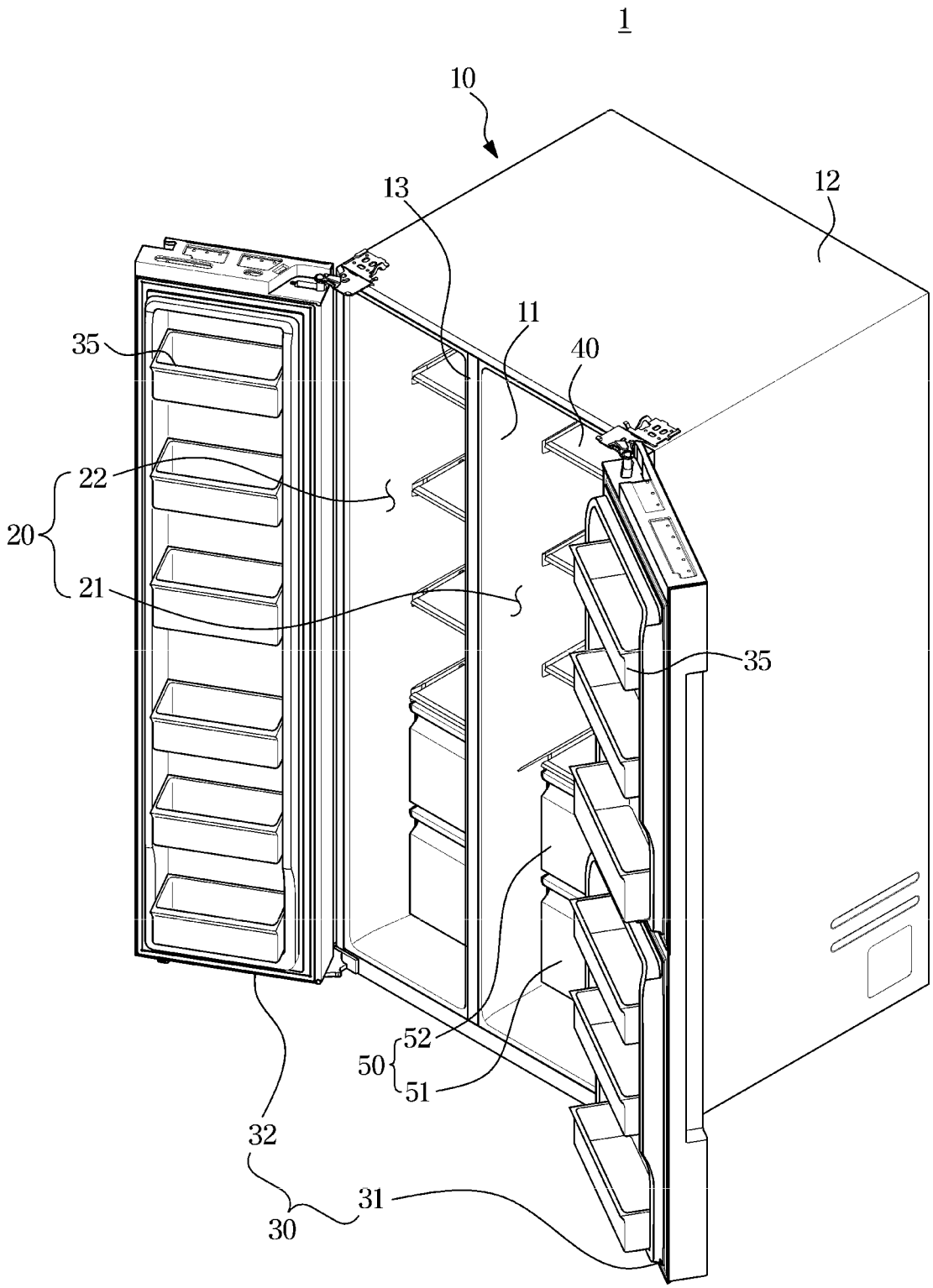
FIG. 1 shows a refrigerator, according to an embodiment of the disclosure.

Embodiments and features as described and illustrated in the disclosure are merely examples, and there may be various modifications replacing the embodiments and drawings at the time of filing this application.

Throughout the drawings, like reference numerals refer to like parts or components. For the sake of clarity, the elements of the drawings are drawn with exaggerated forms and sizes.

The terminology used herein is for the purpose of describing particular embodiments only and is not intended to limit the present disclosure. It is to be understood that the singular forms "a," "an," and "the" include plural references unless the context clearly dictates otherwise.

It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or chamber discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

The disclosure provides a refrigerator equipped with a supporting frame to reduce trembling and noise occurring from a drawer when the drawer is inserted or pulled out.

The disclosure also provides a refrigerator equipped with a supporting frame having an enhanced installation structure to be easily installed in a storeroom.

Reference will now be made in detail to embodiments of the disclosure, which are illustrated in the accompanying drawings, wherein like reference numerals refer to the like elements throughout.

Figure 2:
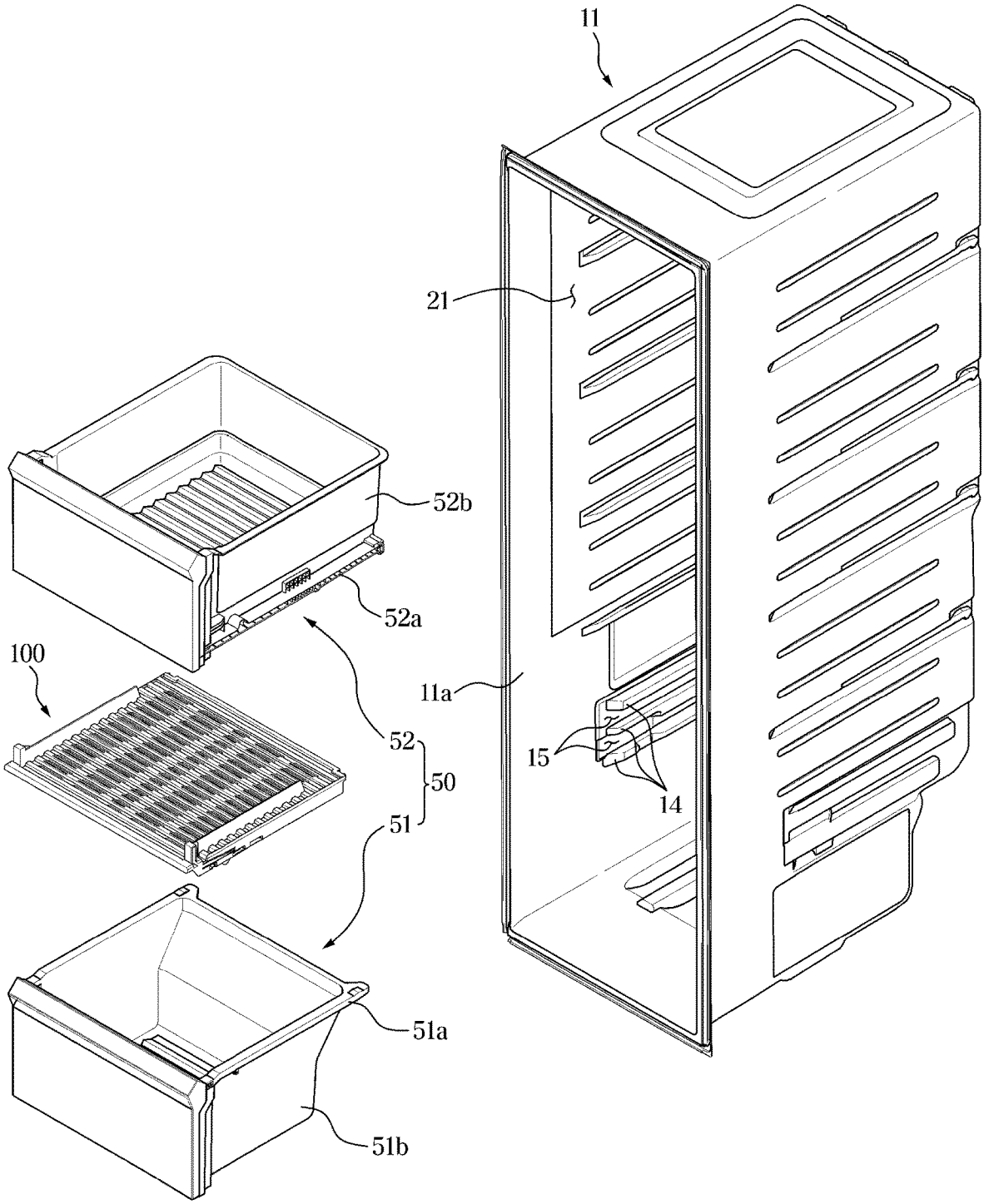
FIG. 2 is an exploded view of the refrigerator shown in FIG. 1 with drawers and a supporting frame separated therefrom.
Figure 3:
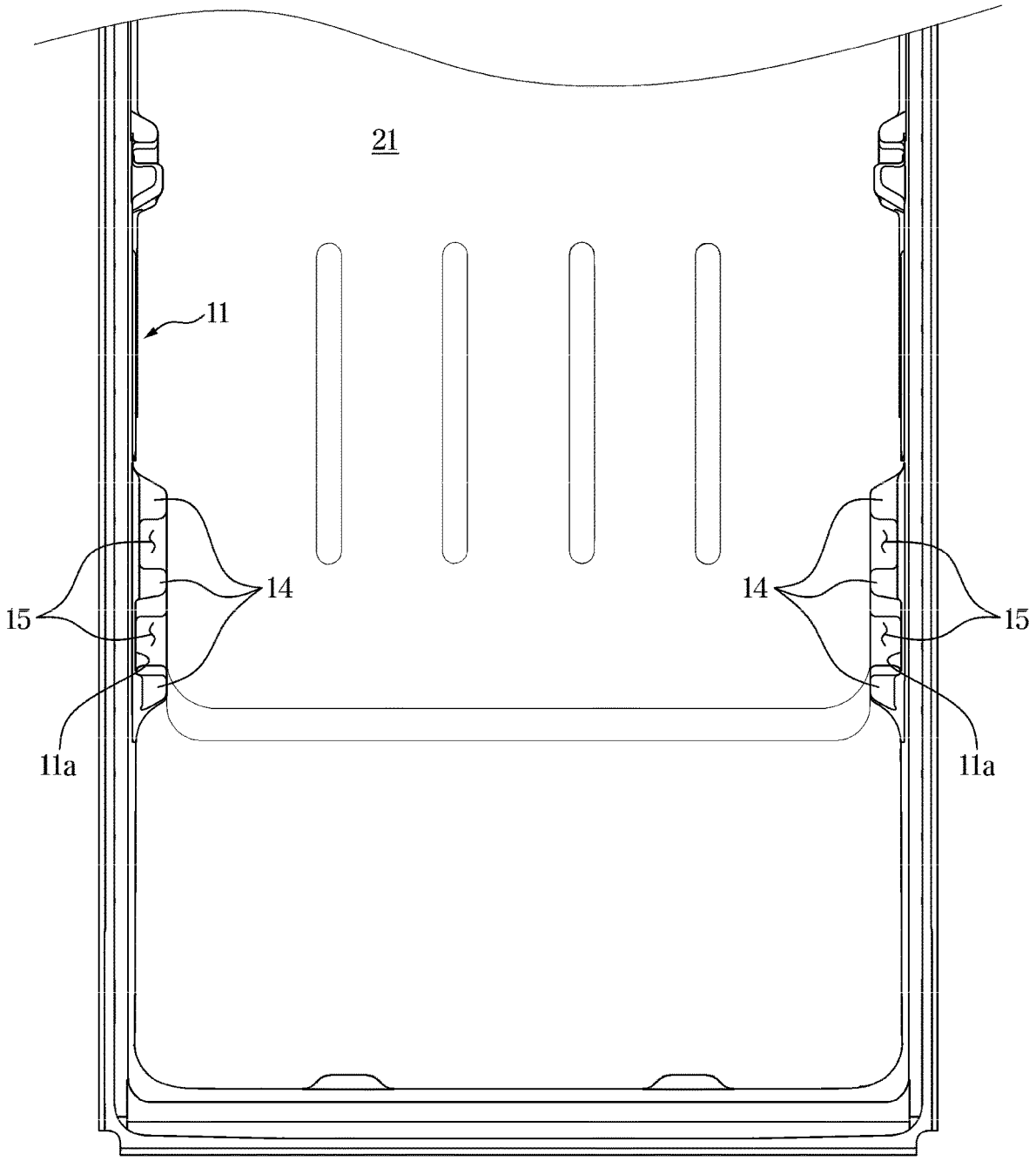
FIG. 3 is a front view of an inner case of the refrigerator shown in FIG. 1.
Figure 4:
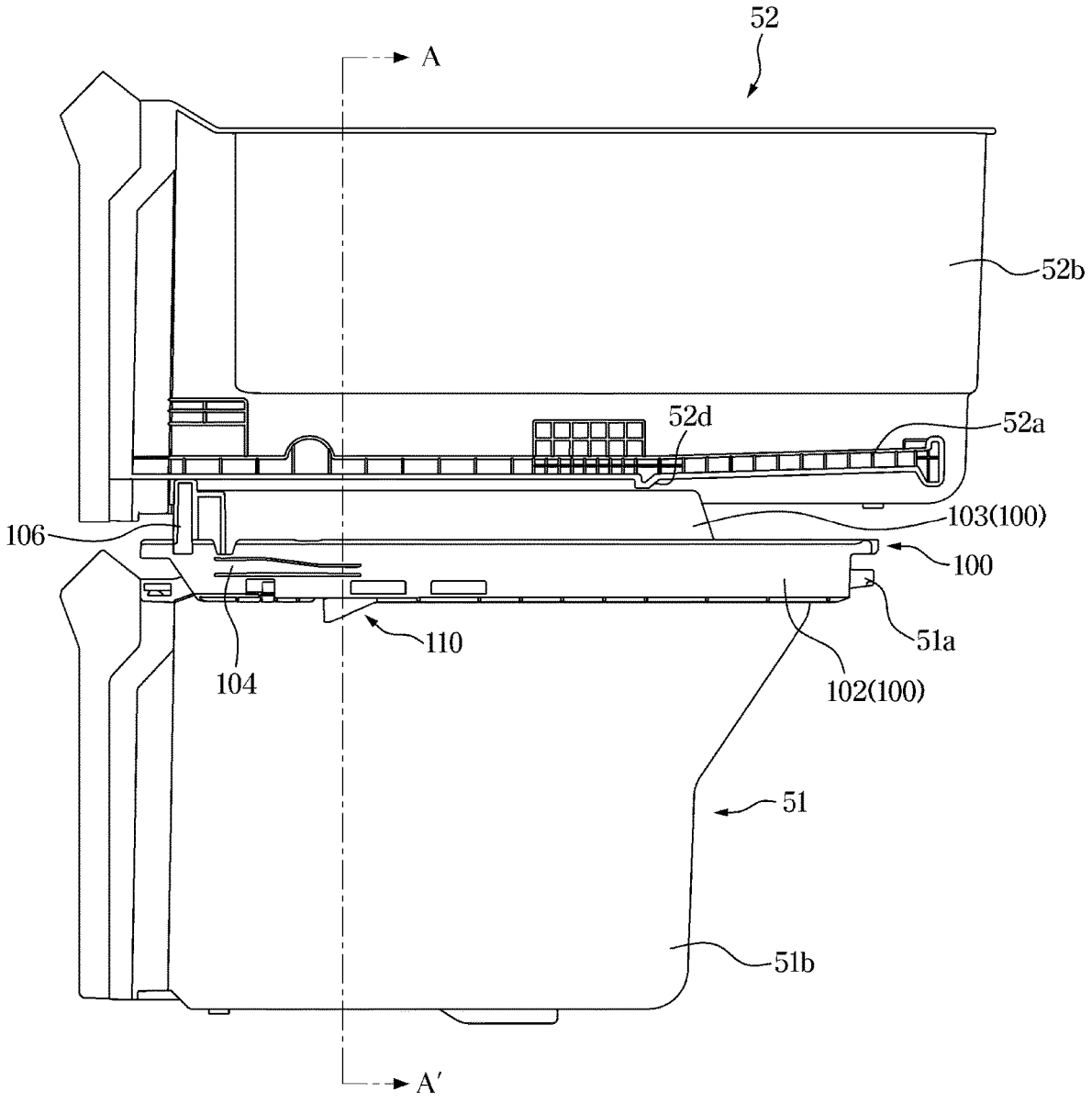
FIG. 4 is a side view of the refrigerator shown in FIG. 1 with a drawer and a supporting frame but a main body.
Figure 5:
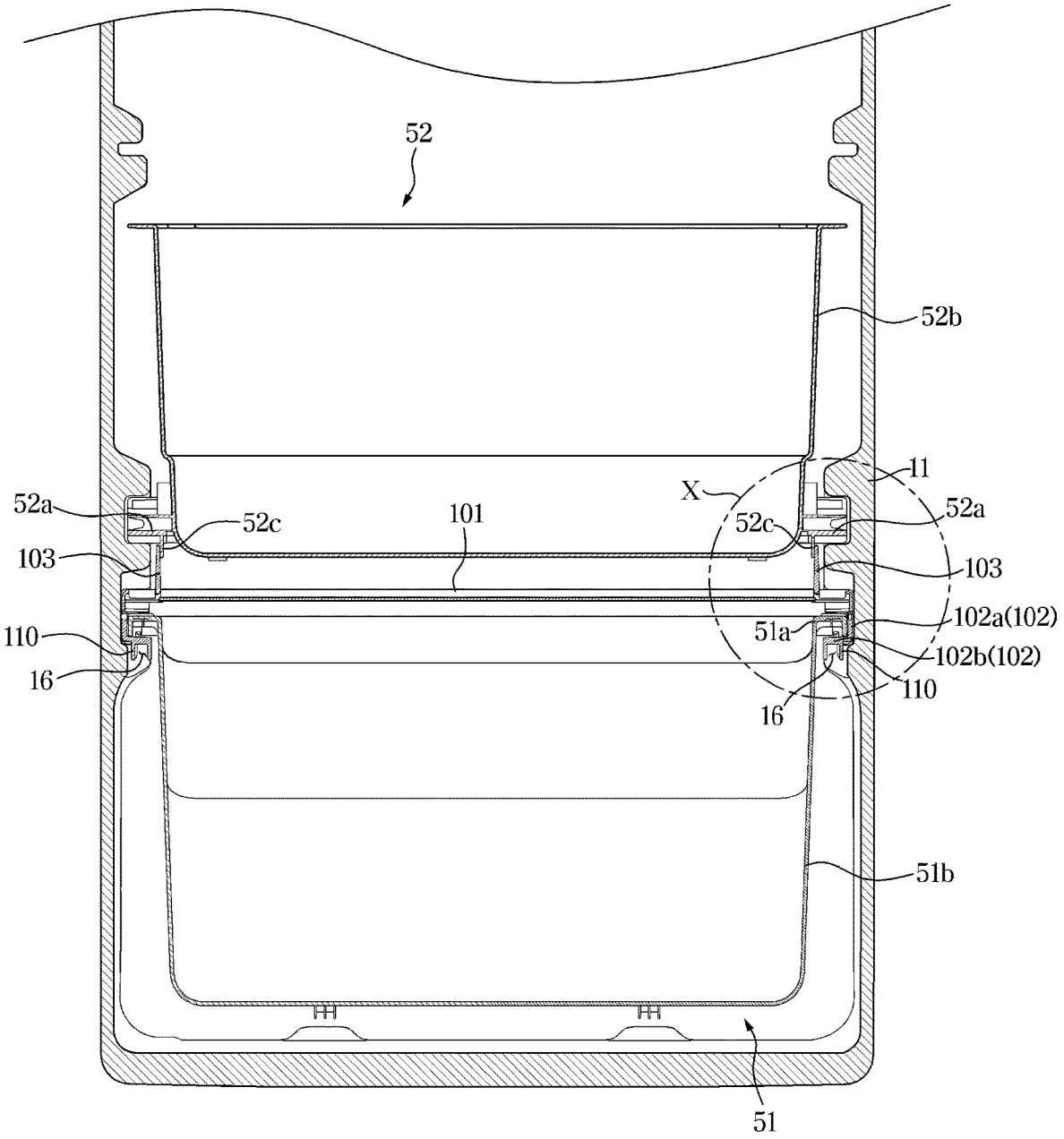
FIG. 5 is a cross-sectional view of the refrigerator shown in FIG. 1 along line A-A' of FIG. 4.
Figure 6:
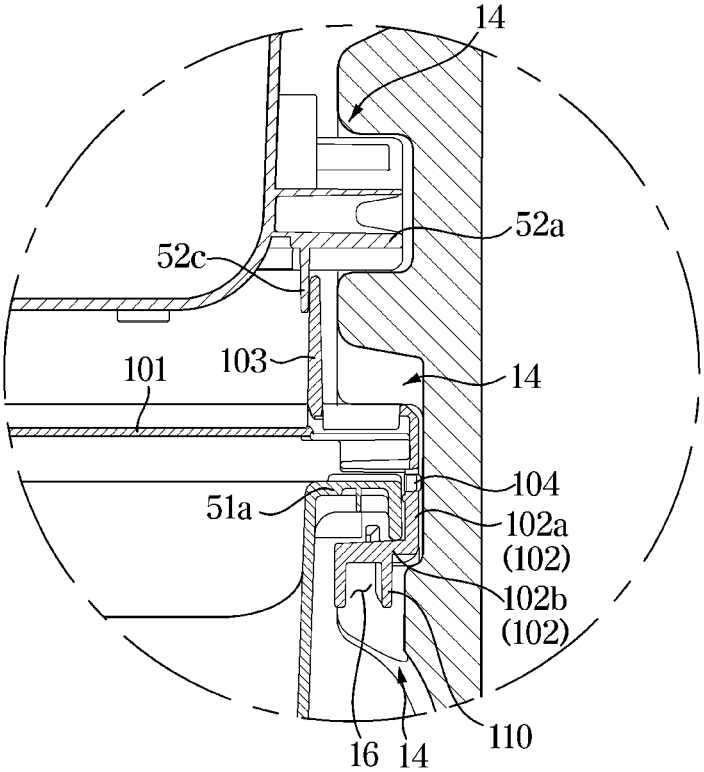
FIG. 6 is an enlarged view of portion X of FIG. 5.

FIG. 1 shows a refrigerator, according to an embodiment of the disclosure. FIG. 2 is an exploded view of a refrigerator with drawers and a supporting frame separated therefrom. FIG. 3 is a front view of an inner case of the refrigerator shown in FIG. 1. FIG. 4 is a side view of the refrigerator shown in FIG. 1 with a drawer and a supporting frame but a main body. FIG. 5 is a cross-sectional view of the refrigerator shown in FIG. 1 along line A-A' of FIG. 4. FIG. 6 is an enlarged view of portion X of FIG. 5.

Referring to FIGS. 1 to 6, a refrigerator 1 may include a main body 10, a storeroom 20 with the front open, which is provided inside the main body 10, and a door 30 rotationally coupled to the main body 10 to open or close the open front of the storeroom 20.

The main body 10 may include an inner case 11 defining the storeroom 20, an outer case 12 defining the exterior, and a cold air supply (not shown) for supplying cold air to the storeroom 20.

The cold air supply may include a compressor, a condenser, an expansion valve, an evaporator, a fan, a cold air duct, etc., and insulation (not shown) is foamed between the inner case 11 and the outer case 12 of the main body 10 to prevent cold air from leaking out.

The storeroom 20 is divided by a partition wall 13 into a fridge chamber 21 and a freezer chamber 22. The fridge chamber 21 and the freezer chamber 22 may be opened or closed by a fridge door 31 and a freezer door 32, respectively, which are rotationally coupled to the main body 10, and a plurality of door guards 35 may be installed on the rear sides of the door 30 to contain foods.

There may be a plurality of racks 40 provided in the storeroom 20, which may divide the fridge chamber 21 and freezer chamber 22 into a plurality of spaces.

One or more drawers 50 may be detachably arranged in the storeroom 20. The drawer 50 may make an accommodating room to keep groceries inside, and may be arranged in a lower portion of the fridge chamber 21 or the freezer chamber 22 to be inserted thereto or pulled out therefrom.

A supporting frame 100 may be arranged in the storeroom 20 to support the drawer 50 and guide movements of the drawer 50. The supporting frame 100 may be inserted to the storeroom 20 through the open front of the storeroom 20 to be placed in the storeroom 20.

The drawer 50 and the supporting frame 100 of the fridge chamber 21 will now be described in detail. The description may be equally applied to the freezer chamber 22.

Although a first drawer 51 and a second drawer 52 arranged above the first drawer 51 are shown in the fridge chamber 21 of the refrigerator 1 shown in FIG. 1, embodiments of the disclosure are not limited thereto and there may be the first drawer 51 only or three or more drawers 50 arranged.

A projection 14 may be formed on a side of the inner case 11 that defines the fridge chamber 21. The projection 14 may be integrally formed with the inner case 11. The projection 14 may include a plurality of projections 14, and the second drawer 52 may slide into an installation groove 15 formed by the plurality of projections 14.

The refrigerator 1 may include the supporting frame 100 arranged in the fridge chamber 21.

The supporting frame 100 may be arranged between the first drawer 51 and the second drawer 52 to support the first drawer 51 and the second drawer 52. The first drawer 51 may be slidably coupled with the supporting frame 100.

The supporting frame 100 may be detachably arranged in the fridge chamber 21. The supporting frame 100 may be inserted to and detachably installed in the installation groove 15 formed by the plurality of projections 14, and both side edges of the supporting frame 100 may be supported by the projections 14. Specifically, a first guide rib 102 is inserted to the installation groove 15 so that the supporting frame 100 may be installed at the projection 14, in which case the projections 14 may be placed above and underneath the first guide rib 102.

Figure 7:
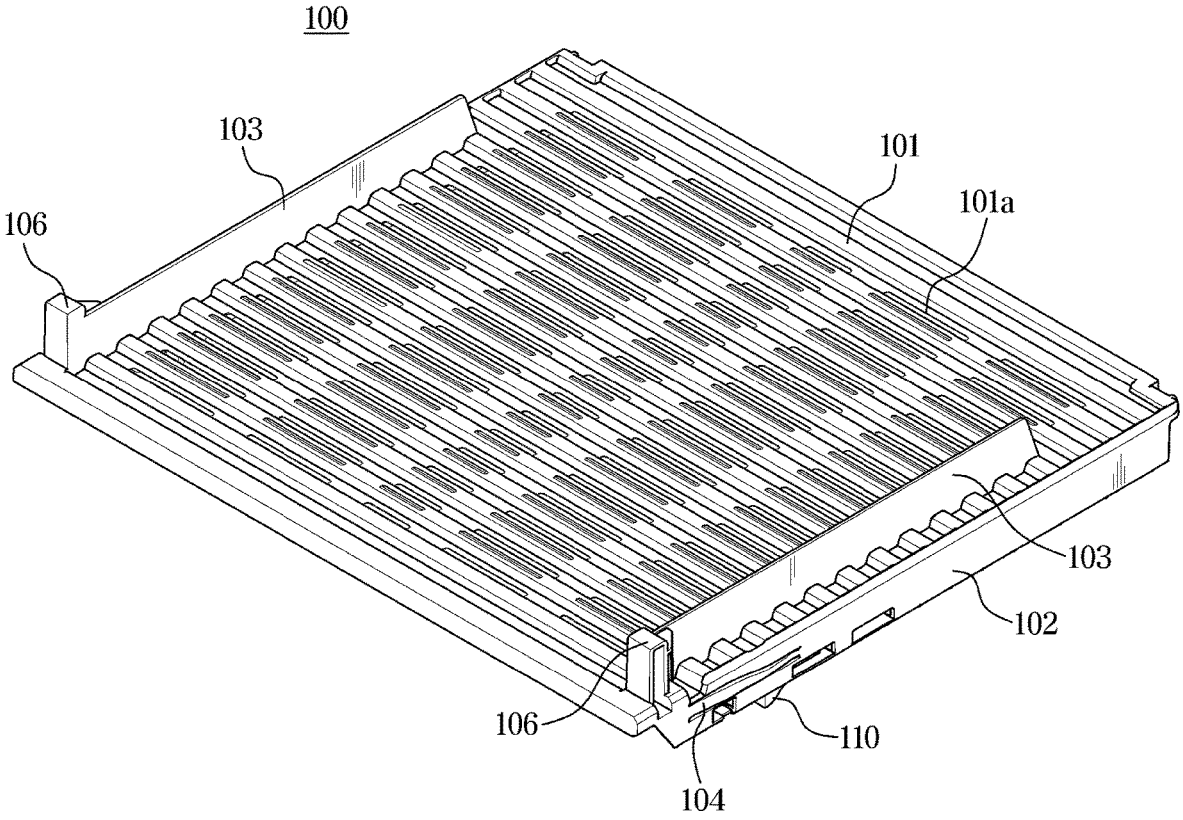
FIG. 7 shows a supporting frame equipped in the refrigerator shown in FIG. 1.
Figure 8:
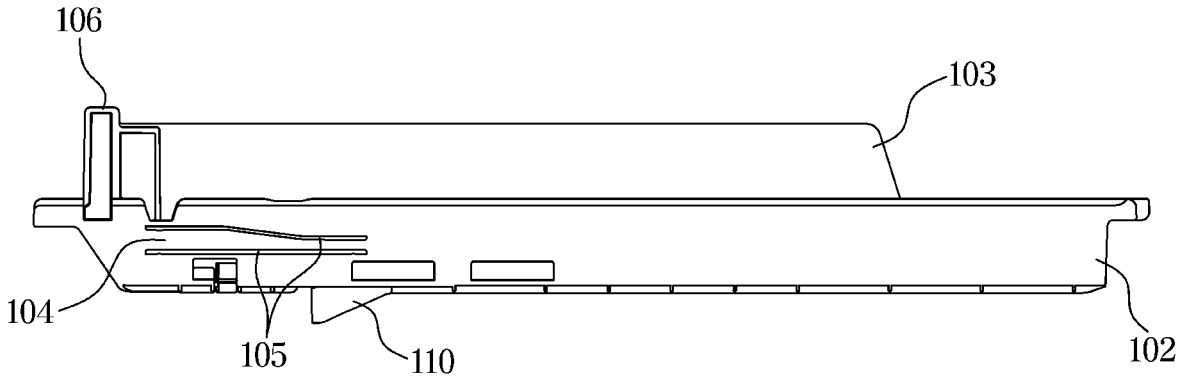
FIG. 8 is a side view of the supporting frame shown in FIG. 7.
Figure 9:
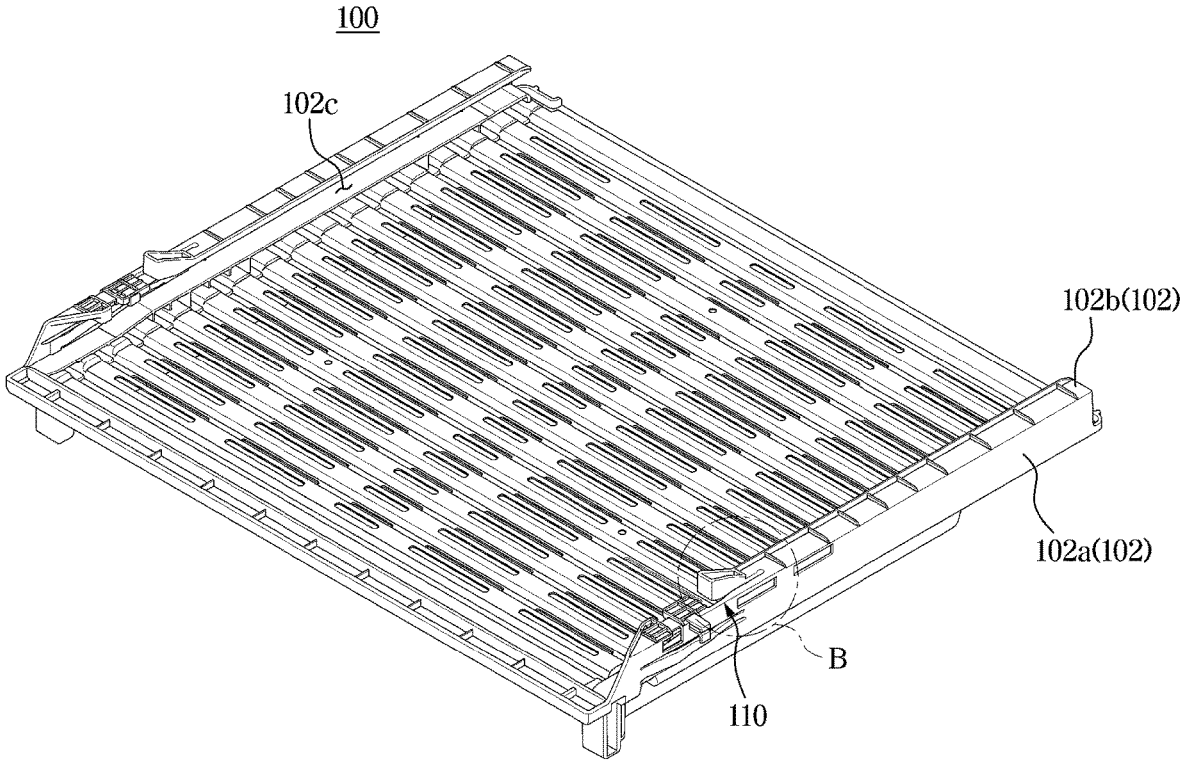
FIG. 9 is a bottom perspective view of the supporting frame shown in FIG. 7.
Figure 10:
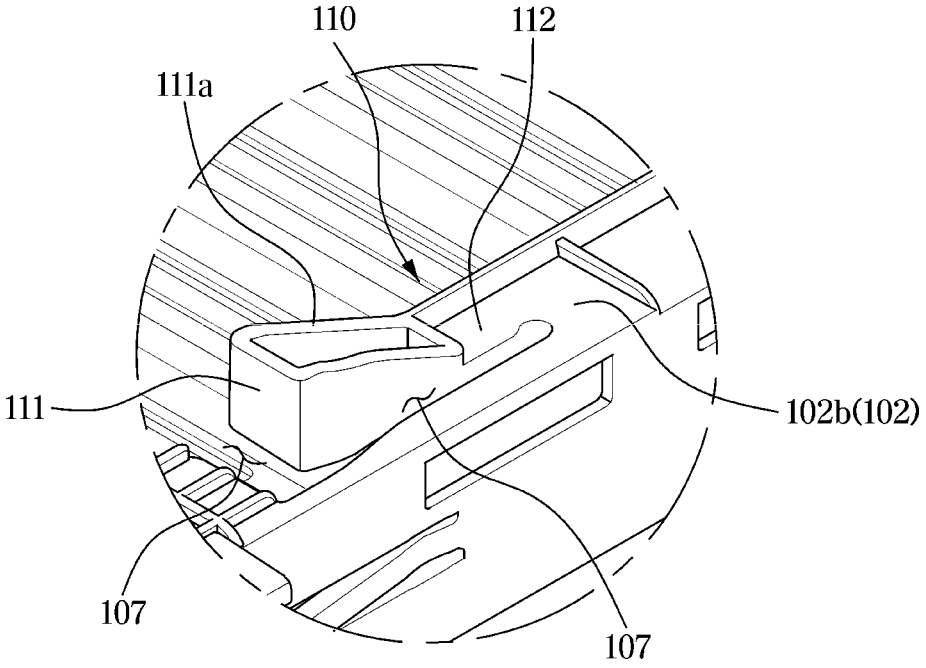
FIG. 10 is an enlarged view of portion B of FIG. 9.

FIG. 7 shows a supporting frame equipped in the refrigerator shown in FIG. 1. FIG. 8 is a side view of the supporting frame shown in FIG. 7. FIG. 9 is a bottom perspective view of the supporting frame shown in FIG. 7. FIG. 10 is an enlarged view of portion B of FIG. 9.

Referring to FIGS. 6 to 10, the supporting frame 100 may include a main body 101, the first guide rib 102, and a second guide rib 103.

The main body 101 may be provided as a plate shaped member, and may have a plurality of holes 101*a* formed to have sufficient strength while saving materials required to manufacture the main body 101.

The first guide rib 102 may include a plurality of first guide ribs 102. The first guide rib 102 may be formed to extend downwards from the main body 101 at both sides of the main body 101. The first guide rib 102 may be formed at edges of either side of the main body 101 to extend downwards. The first guide rib 102 may be integrally formed with the main body 101. Specifically, a first portion 102*a* of the first guide rib 102 may correspond to a side surface of the main body 101.

The first guide rib 102 may include the first portion 102*a* vertically protruding from the horizontal main body 101, and a second portion 102*b* extending from the end of the first portion 102*a* to be parallel to the main body 101. The first portion 102*a* and the second portion 102*b* may be integrally formed.

The first guide rib 102 may form a guide groove 102*c* to which the first drawer 51 may be inserted. Specifically, the guide groove 102*c* may include a space surrounded by the main body 101, the first portion 102*a*, and the second portion 102*b*. Top edges of the first drawer 51 may be slidably inserted to the guide groove 102*c*, making the first drawer 51 slidably coupled with the supporting frame 100.

More specifically, guide rails 51*a* formed to extend sideways from the first drawer 51 may be arranged on top left and top right edges of the first drawer 51, and the guide rail 51*a* may be slidably inserted to the guide groove 102*c*. The guide rail 51*a* may be integrally formed with an accommodating portion 51*b* of the first drawer 51, which defines an accommodating room.

As the guide rail 51*a* is stably supported by the first guide rib 102, the first drawer 51 may be prevented from trembling from side to side while the first drawer 51 is sliding into the guide groove 102*c*.

The second guide rib 103 may include a plurality of second guide ribs 103, which may protrude upwards from the top surface of the main body 101. Specifically, the second guide rib 103 may be formed to protrude upwards from the top surface of the main body 101 on both sides of the main body 101.

The second drawer 52 may be arranged to be put in or pulled out as a guide rail 52*a* formed on a lower portion of an accommodating portion 52*b* is inserted to the installation groove 15 formed by the projection 14. A supporting rib 52*c* protruding downwards from the guide rail 52*a* may be formed at the guide rail 52*a*. The second guide rib 103 may come into contact with the supporting rib 52*c* from the lower portion of the side of the second drawer 52, and thus support the lower portion of the side of the second drawer 52. Accordingly, the second guide rib 103 may prevent the second drawer 52 from trembling from side to side while the second drawer 52 is put in or pulled out.

However, it is not limited thereto. The supporting rib 52*c* may be omitted from the second drawer 52, and the second guide rib 103 may contact the lower portion of the side of the accommodating portion 52*b* of the second drawer 52 to support the second drawer 52.

An elastic supporter 104, which is elastically deformable, may be arranged on a side of the main body 101 of the supporting frame 100. The elastic supporter 104 may include a plurality of elastic supporters 104. The elastic supporter 104 may be formed of an elastic material such as a synthetic resin. The elastic supporter 104 may be integrally formed with the main body 101. The elastic supporter 104 and the main body 101 may be formed of the elastic material.

Separation slits 105 may be formed above and underneath the elastic supporter 104 to separate the elastic supporter 104 from the side of the main body 101. Left and right of the elastic supporter 104 may be connected to the side of the main body 101.

While no external force is applied to the elastic supporter 104 (hereinafter, referred to as a non-pressurized state), the elastic supporter 104 may protrude sideways from the main body 101 of the supporting frame 100.

When the supporting frame 100 is inserted to the installation groove 15, the elastic supporter 104 comes into contact with a side 11*a* of the inner case 11 and may be in a state of being pressurized by the side 11*a* of the inner case 11 (hereinafter, referred to as a pressurized state).

In the pressurized state, the elastic supporter 104 may protrude sideways from the main body 101 less than in the non-pressurized state. In other words, it is pressurized by the side 11*a* of the inner case 11 and may be elastically deformed in the left and right direction.

The elastically deformed elastic supporter 104 in the pressurized state may exert restitution force to the side 11*a* of the inner case 11 to be restored back into the non-pressurized state. Furthermore, even when a crack is made due to a gap between a side of the main body 101 and the side 11*a* of the inner case 11 or trembling of the supporting frame 100, the elastic supporter 104 in the pressurized state may be elastically restored as much as the width of the crack, keeping contact with the side 11*a* of the inner case 11.

Accordingly, left or right movements of the supporting frame 100 may be prevented, and the supporting frame 100 may be stably supported.

The supporting frame 100 may include a stopper 106. The stopper 106 may be formed to protrude from the top of the main body 101 of the supporting frame 100.

The stopper 106 may restrict movement radius of the second drawer 52. Specifically, a stopping projection 52*d* may be formed at the guide rail 52*a* of the second drawer 52 to correspond to the stopper 106, and movements of the stopping projection 52*d* may be restricted by the stopper 106. The guide rail 52*a* and the stopping projection 52*d* may be integrally formed.

More specifically, the stopping projection 52*d* may be put in or pulled out in sync with the second drawer 52, but when the second drawer 52 is pulled out beyond a certain range, the stopping projection 52*d* is interfered by the stopper 106, thereby restricting the movement range of the second drawer 52. Accordingly, the second drawer 52 may be prevented from being overly pulled out and deviating from the installation groove 15.

The supporting frame 100 may include a fixer 110 arranged on either side of the supporting frame 100 to prevent the supporting frame 100 from deviating from the projection 14. The fixer 110 may include a plurality of fixers 110.

The fixer 110 may be formed on the bottom surface of the first guide rib 102. Specifically, the bottom surface of the first guide rib 102 may be formed by the second portion 102*b*, and the fixer 110 may be formed on the second portion 102*b*. The fixer 110 may be formed such that only a portion of the fixer 110 may be connected to the second portion 102*b* and the remaining portions may be separated from the second portion 102*b*. More specifically, the fixer 110 may be separated from the first guide rib 102 by a cut 107 formed between the fixer 110 and the first guide rib 102, and only one end of the fixer 110 may be connected to the first guide rib 102.

The fixer 110 may include an insertion projection 111 arranged to be separated from the first guide rib 102, and an elastic connector 112 connecting between the first rib 102 and the insertion projection 111.

The insertion projection 111 may have a triangular shape with a slope 111*a*, but it is not limited thereto and it may have a curve. The insertion projection 111 may protrude farther down than the second portion 102*b* of the first guide rib 102.

The elastic connector 112 may have one end connected to the insertion projection 111 and the other end connected to the first guide rib 102. The elastic connector 112 may be formed of an elastic material such as a synthetic resin. Accordingly, when the insertion projection 111 is changed in position with respect to the first guide rib 102, the elastic connector 112 may be elastically deformed.

The insertion projection 111 and the elastic connector 112 may be integrally formed. The insertion projection 111, the elastic connector 112, and the first guide rib 102 may be integrally formed. The insertion projection 111, the elastic connector 112, and the first guide rib 102 may be integrally formed of an elastic material.

Figure 11:
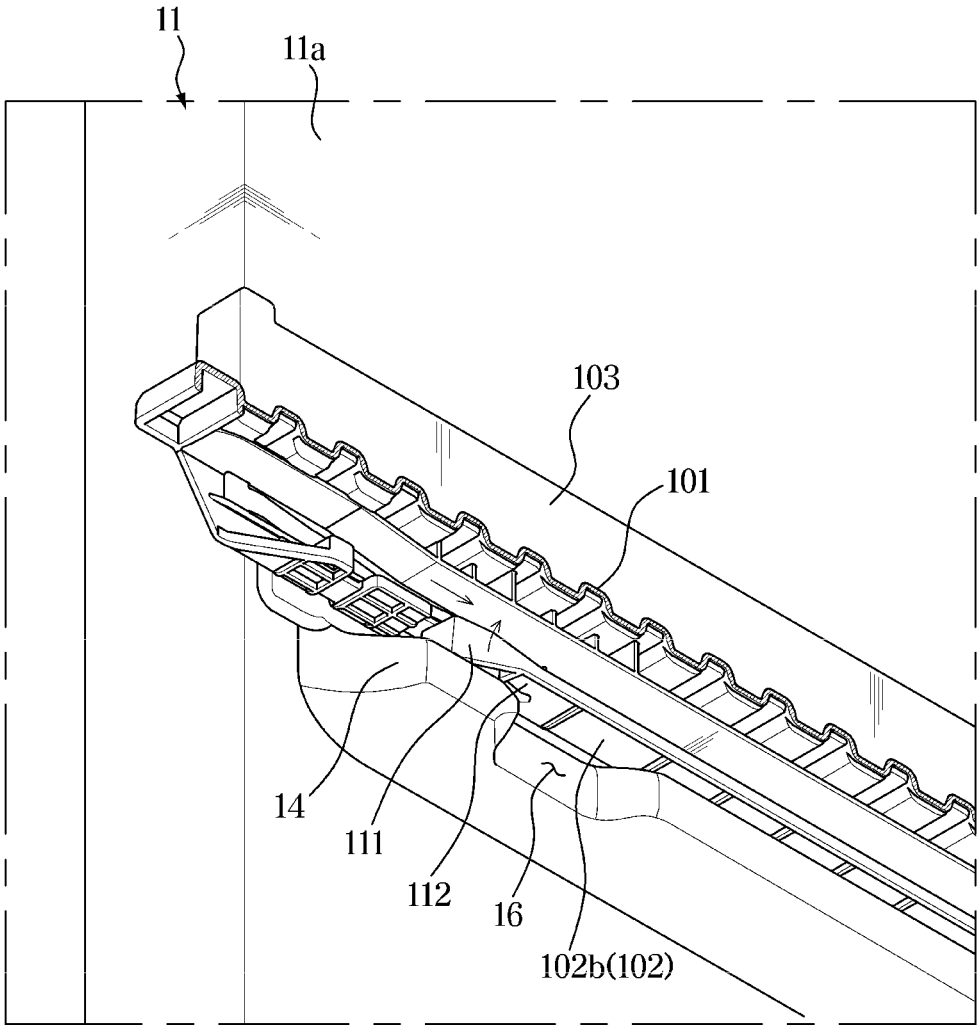
FIG. 11 shows the portion B of the supporting frame of FIG. 9 being inserted to an installation groove.
Figure 12:
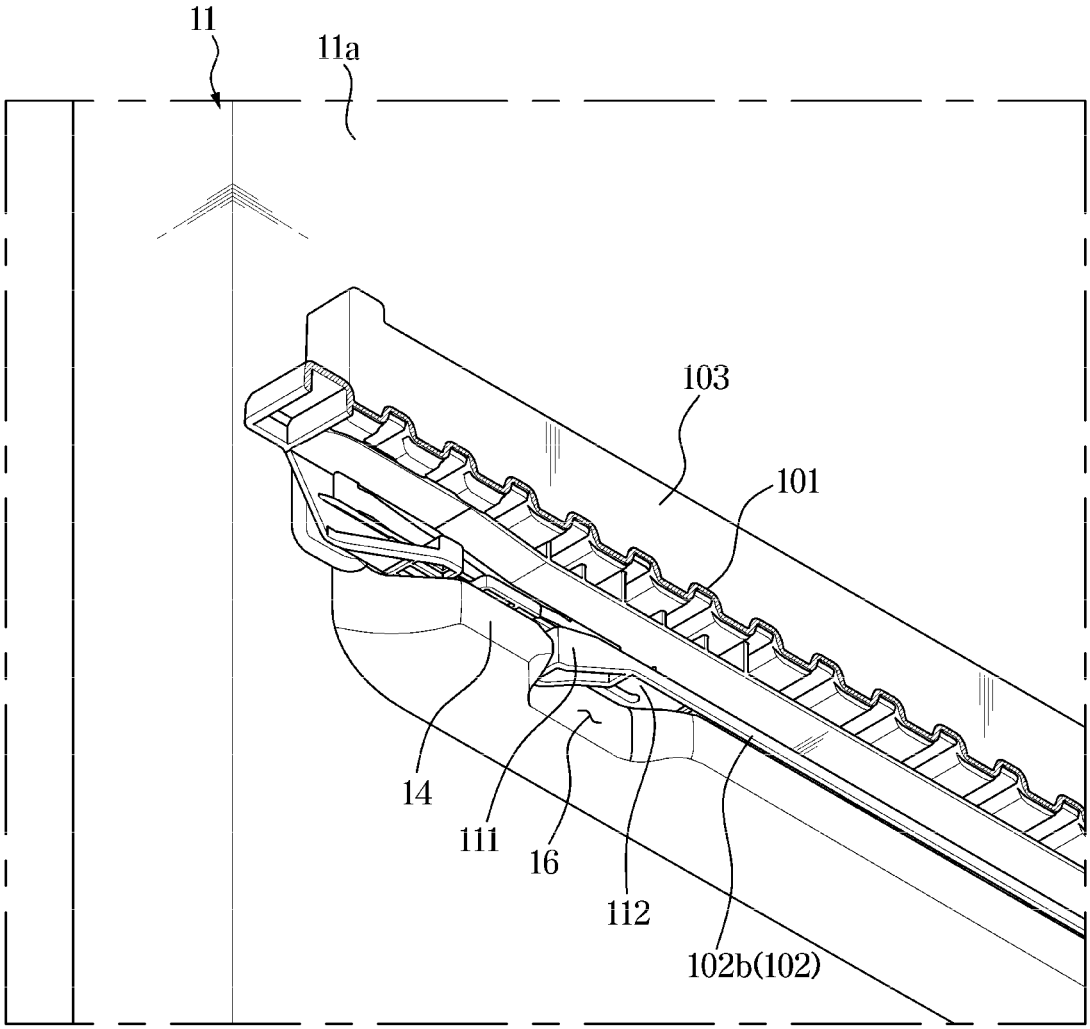
FIG. 12 shows a state in which a fixer of the supporting frame of FIG. 11 is inserted to a fixing groove.

FIG. 11 shows the portion B of the supporting frame of FIG. 9 being inserted to an installation groove. FIG. 12 shows a state in which the fixer of the supporting frame of FIG. 11 is inserted to a fixing groove.

Referring to FIGS. 3, 11 and 12, the supporting frame 100 may be installed at the projection 14. The supporting frame 100 may be inserted to and detachably installed in the installation groove 15 formed by the projection 14. When the supporting frame 100 is installed in the installation groove 15, the supporting frame 100 may be fixed by the fixer 110 not to be deviated from the projection 14.

The fixer 110 is inserted to a fixing groove 16 formed at the projection 14, so that the supporting frame 100 may be installed at the projection 14. Specifically, the insertion projection 111 of the fixer 110 may be inserted to the fixing groove 16.

While no external force is applied to the fixer 110 (in the non-pressurized state), the fixer 110 may be located side by side with the second portion 102*b* of the first guide rib 102. Specifically, the elastic connector 112 of the fixer 110 may be located on the same plane with the second portion 102*b* of the first guide rib 102, and the insertion projection 111 of the fixer 110 may protrude farther down than the second portion 102*b* of the first guide rib 102.

When the supporting frame 100 is pushed into the installation groove 15 to install the supporting frame 110 at the projection 14, a portion of the projection 14 may pressurize the fixer 110. In particular, the portion of the projection 14 may pressurize the insertion projection 111 so that the insertion projection 111 is moved from the downward direction to the upward direction.

While the insertion projection 111 is pressurized by the projection 14 (in the pressurized state), the insertion projection 111 is in a position different from when it is in the non-pressurized state, with respect to the second portion 102*b* of the first guide rib 102. Specifically, as the insertion projection 111 is pushed upwards, the insertion projection 111 in the pressurized state has a smaller portion than in the non-pressurized state, which protrudes farther down than the second portion 102*b* or may not protrude farther down than the second portion 102*b*.

Accordingly, the supporting frame 100 being pushed into the installation groove 15 to be installed therein may be inserted into the installation groove 15 without being interfered by the insertion projection 111, so that the supporting frame 100 may be easily installed.

In the pressurized state, the elastic connector 112 may be elastically deformed. Specifically, the elastic connector 112, which stays as a flat plate in the non-pressurized state, may bend according to a change in position of the insertion projection 111 connected to an end of the elastic connector 112. More specifically, as the elastic connector 112 has one end connected to the insertion projection 111 and the other end connected to the second portion 102*b* of the first guide rib 102, the elastic connector 112 in the pressurized state may be elastically deformed such that the one end comes above the second portion 102*b*.

As shown in FIG. 11, the elastic connector 112 may be located behind the insertion projection 111 to connect the insertion projection 111 to the second portion 102*b* of the first guide rib 102. However, it is not limited thereto.

Figure 13:
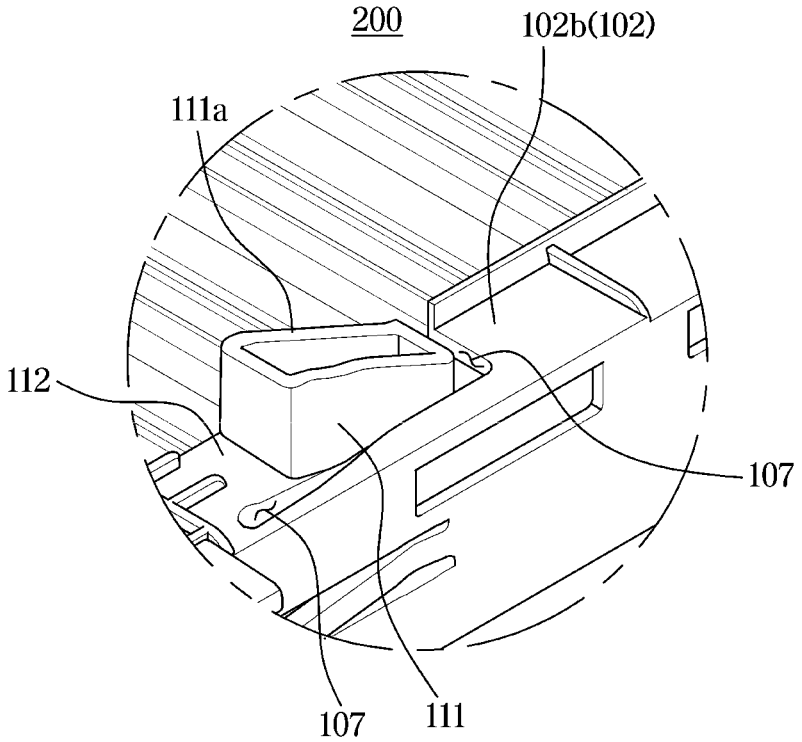
FIG. 13 is an enlarged view of a fixer of a supporting frame of a refrigerator, according to another embodiment of the disclosure.
Figure 14:
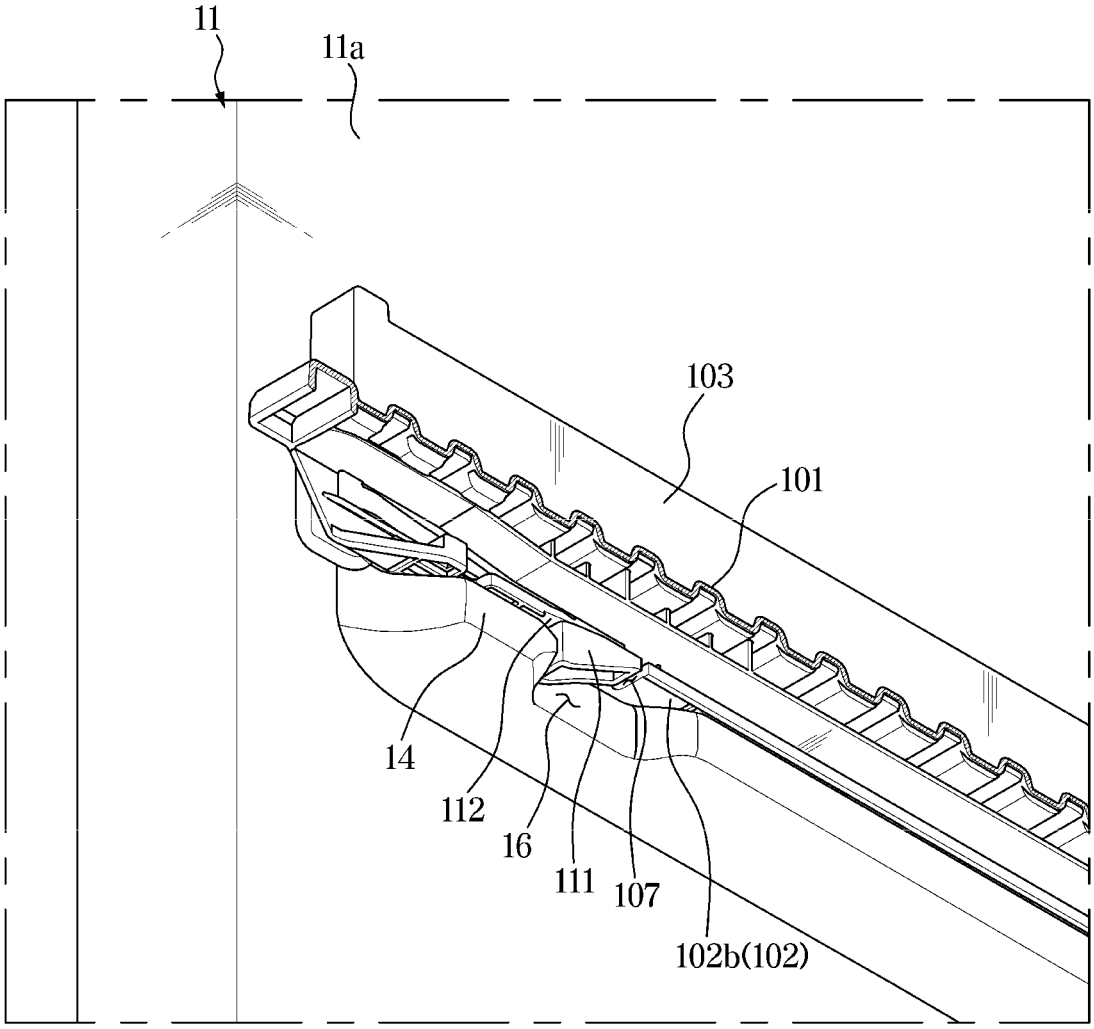
FIG. 14 shows a state in which the fixer of the supporting frame of FIG. 13 is inserted to a fixing groove.

FIG. 13 is an enlarged view of a fixer of a supporting frame of a refrigerator, according to another embodiment of the disclosure. FIG. 14 shows a state in which the fixer of the supporting frame of FIG. 13 is inserted to a fixing groove. Descriptions of parts overlapping the foregoing will not be repeated.

Referring to FIGS. 13 and 14, as in a supporting frame 200 shown in FIG. 13, the elastic connector 112 may be located in front of the insertion projection 111 to connect the insertion projection 111 to the second portion 102*b* of the first guide rib 102. Besides, as will be described below, the elastic connector 112 may be arranged in any position at which to deliver restitution force to the insertion projection 111.

The following description may be equally applied to the supporting frame 200 shown in FIG. 13.

Turning back to FIGS. 3, 11 and 12, the fixing groove 16 may be formed at the projection 14 in a position that corresponds to the fixer 110. Specifically, the fixing groove 16 may be formed in a position where the insertion projection 111 is placed when the supporting frame 100 is fully inserted and installed. Accordingly, when the supporting frame 100 is pushed into the installation groove 15 in the pressurized state and fully inserted to and installed at the installation groove 15, the fixing groove 16 formed at the projection 14 may come under the insertion projection 111.

When the insertion projection 111 is located above the fixing groove 16, the insertion projection 111 is not in contact with the projection 14 that has been pushed the insertion projection 111, and the pressure from the projection 14 is released. Once the pressure from the projection 14 is released, the elastic connector 112 that has been in an elastically deformed state may be restored into its original state according to restitution force.

Specifically, the elastic connector 112 may be elastically restored such that one end of the elastic connector 112, which has been above the second portion 102*b* along with the insertion projection 111 in the pressurized state, may be located back on the same plane with the second portion 102*b*. That is, it may be restored back into the non-pressurized state.

In this case, the insertion projection 111 connected to the restored end of the elastic connector 112 does not have the projection 14 underneath it, and may thus be moved downwards along with the end of the elastic connector 112 and may protrude farther down than the second portion 102*b*. That is, the elastic connector 112 may be able to deliver restitution force to the insertion projection 111, and the fixer 110 may go back into the non-pressurized stat.

The insertion projection 111 of the fixer 110 restored into the non-pressurized stat may protrude farther down than the second portion 102*b* and may be inserted to the fixing groove 16 located underneath it. Accordingly, the fixer 110 may fix the supporting frame 100 to the projection 14 to prevent the supporting frame 100 from easily deviating from the projection 14.

Figure 15:
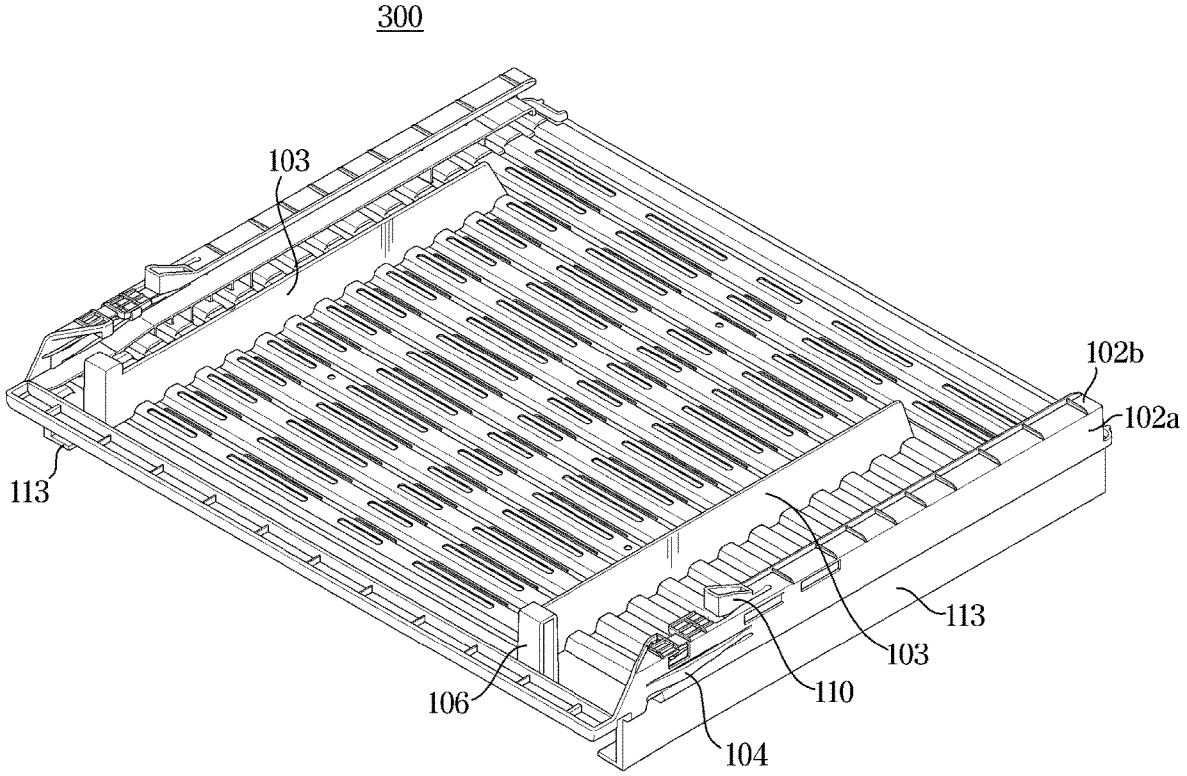
FIG. 15 is a perspective view of a supporting frame of a refrigerator, according to another embodiment of the disclosure.
Figure 16:
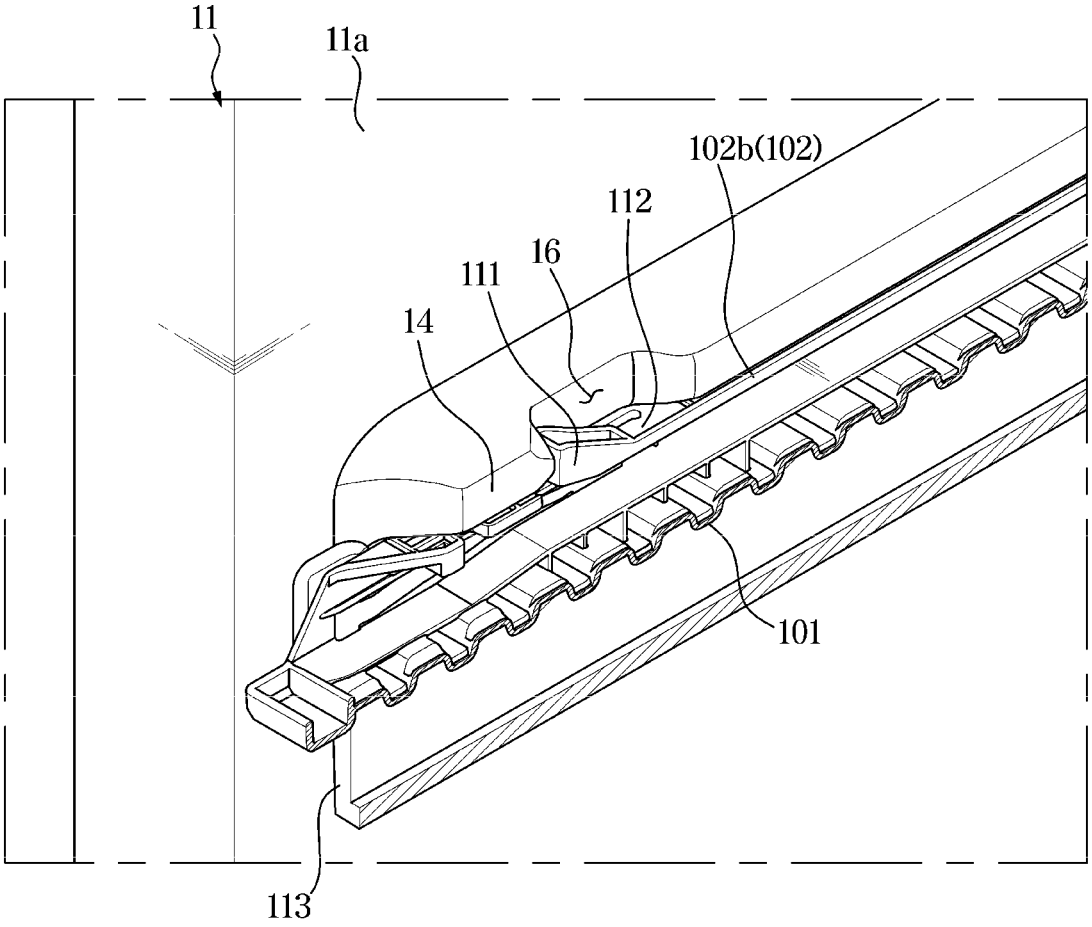
FIG. 16 shows a state in which a fixer of the supporting frame of FIG. 15 is inserted to a fixing groove.

However, it is not limited thereto. FIG. 15 is a perspective view of a supporting frame of a refrigerator, according to another embodiment of the disclosure. FIG. 16 shows a state in which a fixer of the supporting frame of FIG. 15 is inserted to a fixing groove. In FIG. 16, the projection 14 arranged underneath the supporting frame 300 is not shown. Descriptions of parts overlapping the foregoing will not be repeated.

The fixer 110 may protrude upwards from a supporting frame 300. Specifically, the first guide rib 102 on which the fixer 110 is formed may be formed to protrude upwards from the main body 101 at either side edge of the main body 101.

For example, the first guide rib 102 may include the first portion 102*a* vertically protruding upwards from the horizontal main body 101, and the second portion 102*b* extending from the end of the first portion 102*a* to be parallel to the main body 101. In this case, the second portion 102*b* may correspond to the top surface of the first guide rib 102. The fixer 110 may be formed on the second portion 102*b*, and the insertion projection 111 of the fixer 110 may protrude farther up than the second portion 102*b* of the first guide rib 102.

In this case, the supporting frame 300 may include a third guide rib 113 that may guide the first drawer 51. The third guide rib 113 may be formed to extend downwards from the bottom of the main body 300.

When the supporting frame 300 is pushed into the installation groove 15 in the pressurized state and fully inserted to and installed at the installation groove 15, the fixing groove 16 formed at the projection 14 may come above the insertion projection 111. The insertion projection 111 of the fixer 110 restored into the non-pressurized state may protrude farther up than the second portion 102*b* and may be inserted to the fixing groove 16 located above.

Figure 17:
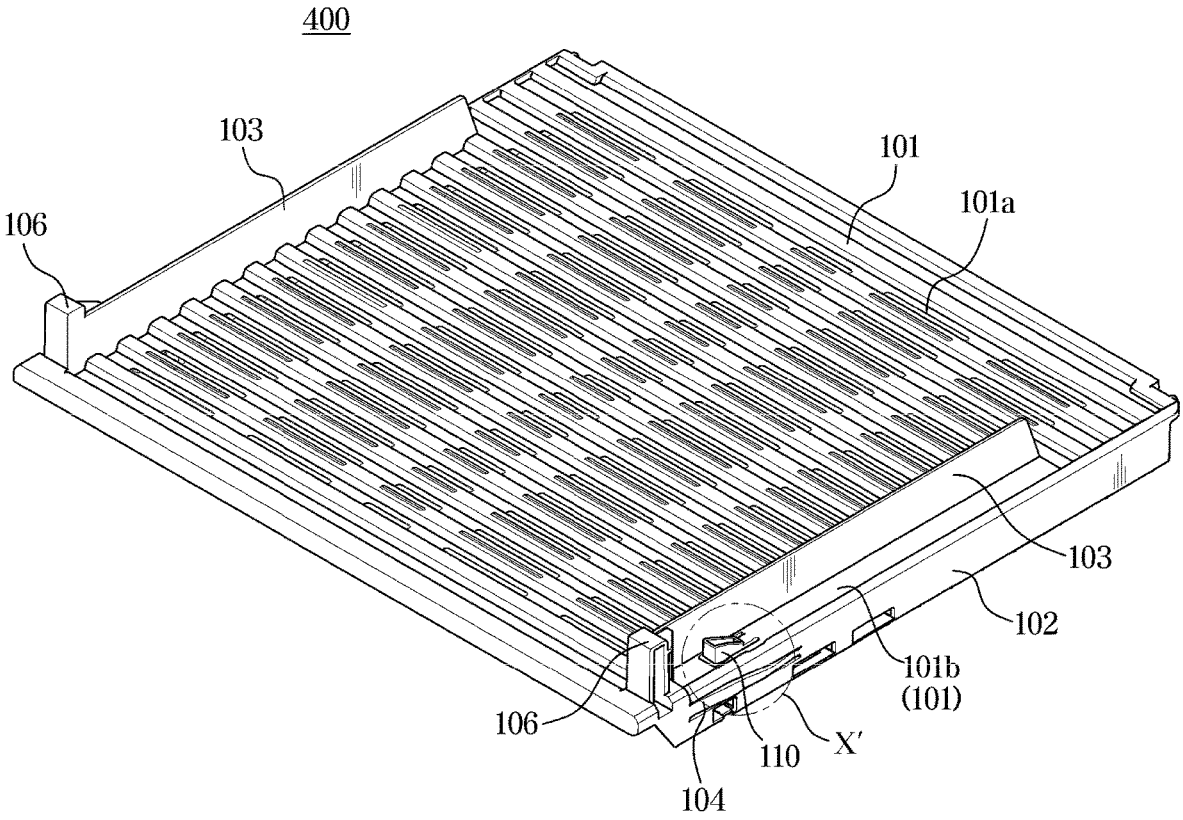
Figure 18:
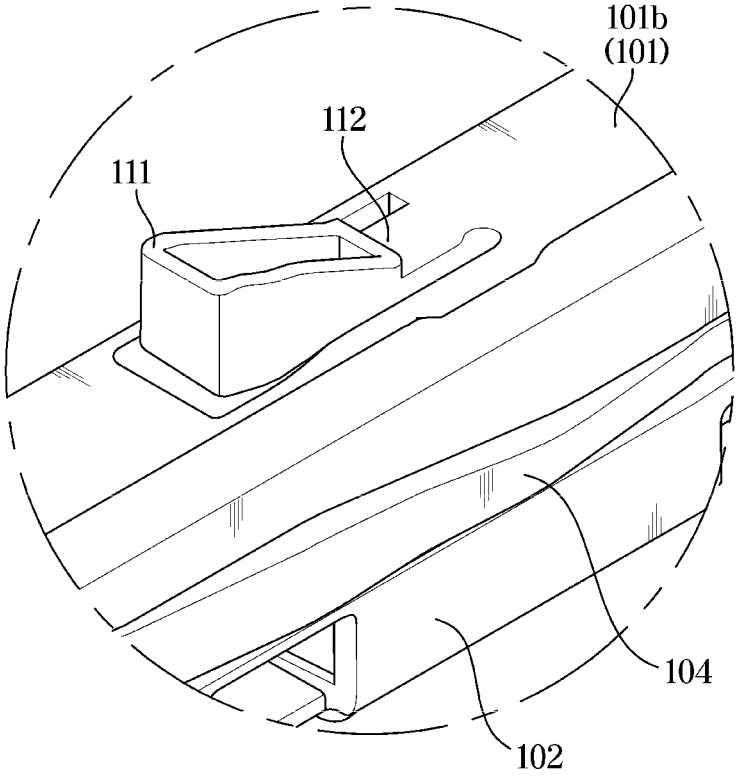
FIG. 18 is an enlarged view of portion X' of FIG. 17.

There may be another example. FIG. 17 is a perspective view of a supporting frame of a refrigerator, according to another embodiment of the disclosure. FIG. 18 is an enlarged view of portion X' of FIG. 17. Descriptions of parts overlapping the foregoing will not be repeated.

The fixer 110 may protrude upwards from a supporting frame 400. Specifically, the fixer 110 may be arranged on either side of a top surface 101*b* of the main body 101 to protrude upwards from the main body 101, and may be located between the first guide rib 102 and the second guide rib 103.

The insertion projection 111 of the fixer 110 may protrude farther up than the top surface 101*b* of the main body 101. A portion of the top surface 101*b* of the main body 101, on which the fixer 110 is formed, may be formed to be flat.

When the supporting frame 400 is pushed into the installation groove 15 in the pressurized state and fully inserted to and installed at the installation groove 15, the fixing groove 16 formed at the projection 14 may come above the insertion projection 111. The insertion projection 111 of the fixer 110 restored into the non-pressurized state may protrude upwards from the main body 101 and may be inserted to the fixing groove 16 located above.

A supporting frame supports a drawer and guides movements of the drawer, so that trembling of the drawer may be reduced and noise occurring when the drawer collides with an inner case may be reduced.

The supporting frame is equipped with an elastically deformable fixer, by which the supporting frame may be easily inserted and fixed to a projection formed at the inner case.

Several embodiments of the disclosure have been described above, but a person of ordinary skill in the art will understand and appreciate that various modifications can be made without departing the scope of the disclosure. Thus, it will be apparent to those ordinary skilled in the art that the true scope of technical protection is only defined by the following claims.

What is claimed is:

1. A refrigerator comprising:

an inner case defining a storeroom and having a projection formed to protrude toward an inside of the storeroom;

a drawer arranged to be inserted into and pulled out from the storeroom; and a supporting frame formed in a plate shape and formed to extend across a width of the drawer, the supporting frame installed at the projection of the inner case in the storeroom to guide a movement of the drawer, wherein the supporting frame comprises:

a guide rib formed to guide the movement of the drawer, and a fixer arranged on a side of the supporting frame to prevent the supporting frame from deviating from the projection, the fixer formed on a bottom surface of the guide rib and configured to be deformed from an original state while a pressure is applied by the projection and restored to the original state while the pressure from the projection is released, wherein the projection comprises a fixing groove recessed to form a space into which the fixer is insertable, and the supporting frame is fixed to the projection while the fixer is inserted into the fixing groove.

2. The refrigerator of claim 1, wherein the fixer comprises an insertion projection arranged to be separated from the guide rib by a cut, and an elastic connector to connect the guide rib to the insertion projection.

3. The refrigerator of claim 2, wherein the elastic connector is elastically deformed as the insertion projection is pushed upwards by the pressure applied from the projection, and restored to an original state of the elastic connector when the pressure from the projection is released.

4. The refrigerator of claim 3, wherein the fixing groove is formed to correspond to the fixer, and the insertion projection is inserted to the fixing groove.

5. The refrigerator of claim 4, wherein the insertion projection is pushed upwards by the pressure from the projection, and when the insertion projection is located above the fixing groove, the pressure from the projection is released and the insertion projection is returned to an original state of the insertion projection and inserted to the fixing groove.

6. The refrigerator of claim 4, wherein the insertion projection has a slope arranged to come into contact with the projection, and the projection pushes up the insertion projection while sliding on the slope.

7. The refrigerator of claim 2, wherein the elastic connector is formed behind the insertion projection.

8. The refrigerator of claim 2, wherein the elastic connector is formed in front of the insertion projection.

9. The refrigerator of claim 1, wherein the supporting frame is inserted to and installed in an installation groove formed by the projection.

10. The refrigerator of claim 1, wherein the supporting frame comprises an elastic supporter formed on the side of the supporting frame on which the fixer is arranged to prevent the supporting frame from moving from side to side.

11. The refrigerator of claim 2, wherein an upper portion of the drawer is slidably inserted to a guide groove formed by the guide rib.

12. The refrigerator of claim 11, wherein the drawer is a first drawer and the guide rib is a first guide rib, and the refrigerator further comprises:

a second drawer arranged above the first drawer, and a second guide rib formed on the supporting frame to guide a movement of the second drawer.

13. The refrigerator of claim 12, wherein the supporting frame comprises a main body arranged between the first drawer and the second drawer, and wherein the first guide rib is formed to protrude downwards from the main body, and the second guide rib is formed to protrude upwards from the main body.

14. The refrigerator of claim 13, wherein the second guide rib supports a lower portion of a side of the second drawer to prevent the second drawer from moving from side to side.

15. A refrigerator comprising:

an inner case defining a storeroom and having a projection formed to protrude toward an inside of the storeroom;

a plurality of drawers arranged in the storeroom to be movable; and a supporting frame arranged to be fixed at the projection between the plurality of drawers to support the plurality of drawers, wherein the supporting frame comprises:

a main body formed in a plate shape and formed to extend across a width of the plurality of drawers;

a guide rib formed to protrude downwards from the main body to support one of the plurality of drawers;

a fixer arranged on the guide rib to be elastically deformable in a vertical direction to fix the supporting frame at the projection; and an elastic supporter arranged on a side of the main body to be elastically deformable in a left and right direction, while pressure is applied by the inner case, to support the supporting frame, wherein the projection comprises a fixing groove recessed to form a space into which the fixer is insertable, and the supporting frame is fixed to the projection while the fixer is inserted into the fixing groove.

16. The refrigerator of claim 15, wherein the guide rib is a first guide rib and the supporting frame further comprises a second guide rib protruding upwards from the main body to support another one of the plurality of drawers.

17. The refrigerator of claim 15, wherein the fixing groove is formed to correspond to the fixer, and the fixer is inserted to the fixing groove.

18. The refrigerator of claim 16, wherein the main body comprises a stopper formed to protrude upwards from the main body to restrict a movement radius of the other one of the plurality of drawers supported by the second guide rib.

19. The refrigerator of claim 18, wherein the other one of the plurality of drawers supported by the second guide rib comprises a stopping projection matching the stopper, wherein the stopping projection moves along with the other one of the plurality of drawers supported by the second guide rib, and wherein the stopper restricts a movement radius of the stopping projection.

* * * * *